United States Patent [19]

Ermakov et al.

[11] 4,203,309

[45] May 20, 1980

[54] METHOD OF PILGER ROLLING OF TUBES

[76] Inventors: Vladimir E. Ermakov, ulitsa Osipenko, 52a, kv. 1, Moscow; Viktor B. Makarov, ulitsa Zelenaya, 4, kv. 12, Khimki Moskovskoi oblasti; Fikrat S. O. Seidaliev, ulitsa Golovacheva, 17, kv. 125, Moscow; Alexandr M. Nikiforov, ulitsa Zamshina, 25, kv. 21, Leningrad; Alexandr V. Bushev, ulitsa Sevanskaya, 7, korpus 2, kv. 324, Moscow; July K. Dozortsev, ulitsa Sadovaya, 16, kv. 4, Vidnoe Moskovskoi oblasti, all of U.S.S.R.

[21] Appl. No.: 843,821

[22] Filed: Oct. 20, 1977

[51] Int. Cl.[2] ..... B21B 17/06; B21B 17/12; B21B 21/00

[52] U.S. Cl. ..... 72/96; 72/208; 72/209; 72/214

[58] Field of Search ..... 72/97, 208, 209, 214, 72/96

[56] References Cited

U.S. PATENT DOCUMENTS

| | | | |
|---|---|---|---|
| 2,264,455 | 12/1941 | Pech | 72/97 X |
| 3,695,076 | 10/1972 | Kochs | 72/97 |
| 3,874,212 | 4/1975 | Nosal et al. | 72/209 |

*Primary Examiner*—Milton S. Mehr

*Attorney, Agent, or Firm*—Lackenbach, Lilling & Siegel

[57] ABSTRACT

The method resides in feeding a billet in portions into pilger rolls to be worked therein on a mandrel. The billet being positively turned about the rolling axis both in one direction and in the opposite direction in the course of deformation thereof and in the off-contact time when the billet is not engaged by the rolls.

5 Claims, 2 Drawing Figures

METHOD OF PILGER ROLLING OF TUBES

Figure 1:
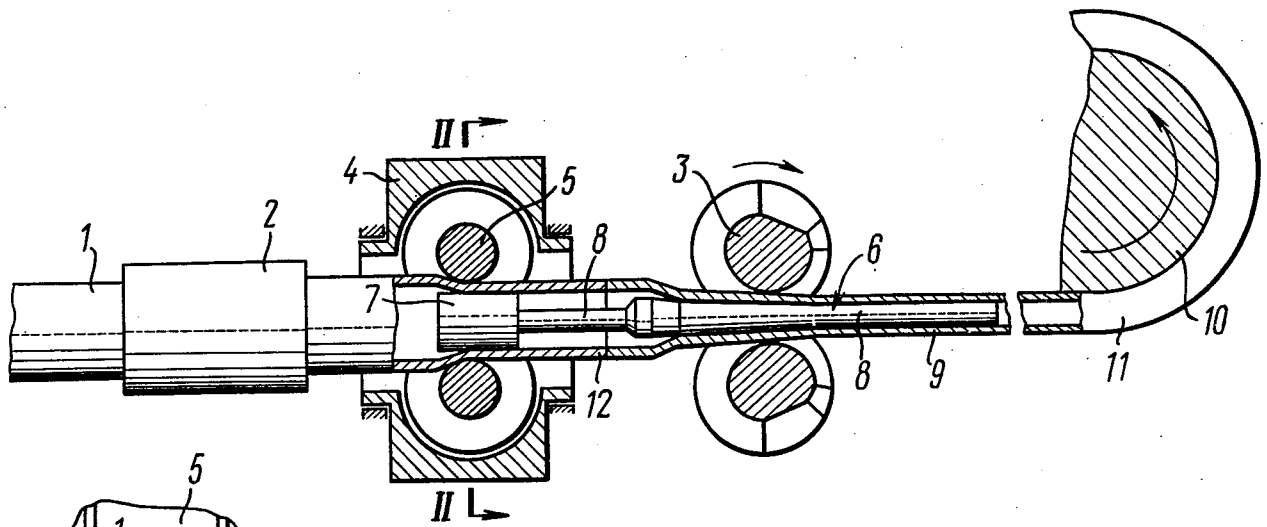

The present invention relates to the production of tubes and more particularly to a method of pilger rolling.

The method of the invention may prove to be most advantageous in pilger rolling of tubes in coils.

Out of the known prior-art procedures for producing tubes in coils, pilger rolling may prove to be the most efficient one in several instances.

Such known method consists essentially in the following. A tubular billet is fed in portions into pilger rolls with the latter working the particular portion of the billet on a mandrel and turning positively the billet about the rolling axis over each rolling period. The rolls are fitted with grooves of variable cross-section, the beginning of said grooves corresponding in size to that of the billet and their end to the size of a finished tube. The roll groove is subdivided along its length into three main zones: a reducing zone, wherein the billet is reduced in diameter; a draft zone adapted for reducing the wall thickness of said billet and, finally, a sizing zone for finishing the tube being rolled. The sections located on both sides of the groove—the so-called bites—are adapted for free passage of the tube. The rolls are set up in a working stand which is mounted for reciprocated movement. As the stand advances, the billet portion fed into the rolls is reduced in diameter, its wall thickness being reduced in a ring-shaped, gradually diminishing gap between the roll grooves and the mandrel.

The turning of the billet is necessary for rolling off fins (the bulges on the external surface of the billet, formed in the rolls clearance) and for giving the tube a round shape. The positive turning of the billet is performed by a turning- and-feeding gear. While rolling tubes in coils, the finished coiled tube does not turn about the rolling axis, as the billet is being positively rotated thereabout. With a view to enabling the rolling of round tubes in coils without fins, the positive turning of the billet is effected at the off-contact moment, when the rolls come out of engagement with the billet. Said turning is carried out through the same angle by varying its direction and by applying a torque from both sides of the area of deformation of the billet (see, e.g. Inventor's Certificate of the USSR No. 403454, filed on Aug. 20, 1972). The main disadvantage of said method resides in an increase in loads acting on the mill turning-and-feeding gear at a higher rolling speed. Usually, the roll-to-billet off-contact time accounts for 1/6 of the rolling period and is equal to almost 0.1 sec. at an average rolling speed of 90 periods per minute. Over that period of time the billet shall be turned through an angle of from 40° to 90°, with the turning gear being rotated through a still greater angle to make up for all backlashes in the turning circuit. Moreover, the turning gear is responsive to the torque induced by elastic-plastic twisting of the finished tube, and when a coiled billet is rolled, to a billet torsional moment. All these factors impede the functioning of the turning-and-feeding gear in view of heavy dynamic loads applied thereto.

By changing the operating conditions of the turning-and-feeding gear, i.e. by extending the turning time and diminishing the billet turning speed, it is possible to reduce the dynamic loads in the billet turning circuit, enhancing thereby the production efficiency and extending the service life of pilger mills.

Such changes have been taken into account in a method of pilger rolling of tubes, comprising the steps of feeding a billet in portions and working said billet on a mandrel by pilger rolls, with the billet being turned both during its deformation and at the instant when it comes out of contact with the rolls, i.e. continuously during the entire rolling process (see. e.g., Inventor's Certificate of the USSR No. 454066, filed on Jan. 26, 1973). In said method, the billet is fed to its deformation area by a feeding gear at the off-contact moment, i.e. when the rolls do not engage the billet. The pilger rolls reciprocating in the area of deformation of said billet reduce the latter on the mandrel to the tube finishing size. During the rolling operation the billet is continuously being turned with a stable angular velocity. However, while rolling a tube in a coil, the billet is turned only when it comes in contact with the rolls. This method is especially well adated for rolling tubes from easy-to-form metals and alloys, insofar as the twisting of the billet caused by its continuous turning result in its additional transverse deformation. Such deformation, on being summed up with that set up during the reduction of the billet, adds to the work hardening of said billet, restricting thereby its elongation during reduction and decreasing the productivity of the rolling equipment.

Said tube rolling procedures suffer from certain limitations imposed either on the alloys, since the rolling of tubes from hard-to-form materials in coils poses an intricatte problem, or on the range of tubes being rolled in view of possible over—leading of the units and elements of the turning-and-feeding gear.

Thus, the above disadvantages render the prior-art methods for rolling tubes in coils from hard-to-form metals and alloys impractical, making the rolling mill incapable of producing a complete and varied range of products as to the diameters and wall thicknesses of tubes.

Accordingly, it is the primary object of the present invention to provide a method of pilger rolling of tubes which will ensure the rolling of tubes in coils from hard-to-form metals and alloys.

Another object of the invention is to broaden the variety and types of tubes being rolled in a coil not only as to their diameters, but also as to their wall thicknesses.

Still another object of the present invention is to increase the service life of equipment for rolling tubes in coils.

Yet another object of the invention is to provide the prerequisites for enhancing plastic properties of processed metals and alloys while rolling tubes in coils.

A further object of the present invention is to provide more favorable conditions of labor, especially while rolling tubes from hard-to-form and alloys.

It is likewise an object of the invention to create conditions for the overall high-quality rolling of large-length tubes in coils.

These and other objects of the invention are achieved in a method of pilger rolling of tubes, comprising the steps of feeding a billet into pilger rolls and working it on a mandrel, with the billet being positively turned about the rolling axis both during its deformation and in the off-contact time, when the rolls come out of engagement with the billet, wherein, according to the invention, said positive turning is performed both in one direction and in the opposite direction.

The method enables tubes of hard-to-form materials to be rolled in coils. With respect to the turning of the tubular billet and variations in the direction of said turn during the entire rolling period, the plastic properties of said billet are improved by decreasing its deformation in a crosswise direction and by changing thereby the diagram of its stressed-strained state.

A decrease in transverse deformation during the rolling process diminishes the load acting on the mill units and gears, and consequently this is a feature which permits extending the range of tubes being rolled.

As compared with the conventional turning of a billet in the roll bites, the turning of the billet along with variations in its direction performed over the entire rolling period decreases several times maximum speeds and accelerations developed in the turning circuit, enhances the longevity of the rolling facilitates and makes it possible to increase rolling speeds.

Moreover, the possibility of changing the direction of rotation of the billet within the entire rolling period enables the speed of the mill components, comprising the billet turning circuit to be reduced still further. This is achieved by increasing the billet turning time between variations of its directions.

The simplest embodiment of the proposed method envisages the turning of the billet through the same angle in each direction. Said turning schedule is especially well adapted for rolling tubes in a coil from straight billet sections.

For the purpose of decreasing to a maximum extent the loads in the billet turning circuit, said turning can be performed not over the entire rolling period but only within its part, e.g., in the roll sizing zone and in their bite. The rolling schedule is well adaptable for rolling tubes both in straight sections and in coils.

The turning of the billet while reducing its wall thickness, i.e. in the draft zone of the rolls, improves the quality of the finished tubes and makes the operation of a gear adapted for winding the tubes in a coil more facile, the turning being in this case not transmitted through the area of deformation to the rolled tube. Said turning scheme provides for more complete utilization of the plastic characteristics of processed metals and alloys, allows increasing the degree of reduction of the billet, ensuring thereby a higher productivity of the rolling equipment that is employed in producing tubes.

The turning of the billet in one direction through a smaller angle as compared with that used in the opposite direction results in a more uniform distribution of the billet bulging zones in the rolls clearance over the entire circumference of the tube, creating therefore the most favorable conditions for the working of said billet. This rolling schedule can find its best use in rolling tubes from both cast hollow and coiled billets.

With a view to providing the prerequisites for the overall high-quality rolling of tubes, particularly when using tubular billets wound in coils, the positive turning of the end portion of said billet, which has just emerged from the turning gear, can be effected by the next billet, following the first one. The turning is adaptable on the rolling mills fitted with a stationary billet turning gear mounted in front of the stand which is furnished with rollers.

Figure 2:
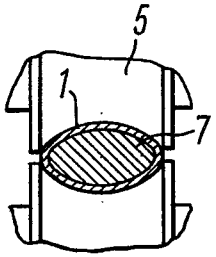

Further objects and advantages of the present invention will become apparent from the following detailed description of an exemplary embodiment thereof taken in conjunction with the accompanying drawings, in which:

FIG. 1 shows a device for effecting the method of pilger rolling of tubes, according to the invention; and FIG. 2 is a cross-sectional view taken along the line II—II in FIG. 1.

Referring now to the drawings and to FIG. 1 in particular, there is shown a device for rolling tubular billets 1 (either shaped as straight sections or coiled) set up in the working receiving line of a rolling mill. Said device comprises a feeding gear 2 adapted for feeding the billet 1 in portions into the zone of action of pilger rolls 3. A turning gear made as a positively turned reducing stand 4 with rollers 5 is adapted for turning the billet 1 positively about the rolling axis. Due to proper sizing of the rollers 5 the billet has an oval shape (FIG. 2) in cross-section. The billet 1 is reduced on a mandrel 6 mounted intermediate of the rolls 3. In said embodiment, use is made of the floating (unfastened) mandrel 6 whose shank 7, set up between the rollers 5, is interconnected through a rod 8 with the remaining part of the mandrel 6. The shank 7 is given an oval shape (FIG. 2) in cross-section, said oval being congruent with the hole in the billet 1 emerging from the rollers 5 of the reducing stand 4.

A line for receiving finished tubes 9, included in the proposed device, comprises a reel 10 for winding the finished tube 9 into a coil 11 during the rolling process. The reel 10 can be replaced by any other prior-art gear or apparatus of the type adapted for reeling the tube 9 into the coil 11.

The tube rolling process is effected in the following manner. The billet 1 is initially fed by means of the feeding gear 2 into the rollers 5, where said billet 1 is formed into an oval cross-sectional configuration. Next at the off-contact moment, i.e. when the rolls 3 come out of engagement with the billet 1, the latter (billet 1) is fed with the help of the gear 2 into the rolls 3, where said billet 1 is reduced on the mandrel 6 during the working stroke of said rolls 3 to the size of the finished tube 9.

During each rolling period the billet 1 is turned by the rollers 5, said turning being effected both during the rolling process and in the off-contact time, when the rolls 3 are brought out of contact with the billet 3, said positive turning being carried out both in one and in the opposite direction. While rolling tubes of non-responsible application the billet 1 is turned through the same angle in the opposite direction.

In the case of rolling tubes from hand-to-form materials as well as when rolling tubes 9 from a coiled billet 1, turning is effected in such a manner that the angle of rotation in one direction will differ from that employed while turning in the opposite direction by about 15°–40°. If that is the case, the process of deformation is facilitated due to uniform distribution of the billet bulging zones over the tube circumference in the gap between the rolls 3. Moreover, said turning creates the prerequisites for the slow and uniform turning of the coiled billet 1 about the rolling axis, with the billet 1 being twisted both in one direction and in the opposite direction through a small angle at the section bounded by said coiled billet 1 and the rollers 5. The difference between the angles of rotation in each direction develops a cumulative twisting moment that is offset by the uniform rotation of the coiled billet towards the greater angle of rotation. While rolling tubes from a straight heavy, e.g. cast billet 1, said turning schedule diminishes also the dynamic loads acting in the turning circuit of the billet 1, such that, an additional gear for providing uniform turning being therefore unnecessary. This is attributable to the fact that at the section of the billet 1, adjoining the turning gear, the twisting moment is smaller than that applied to the entire billet 1. The following example is submitted to illustrate the essence of the rolling process performed by varying the angles of rotation of a billet.

The number of strokes of a mill stand S=90 strokes per minute; the angle of rotation of the billet per rolling period $\alpha=40°$; the billet turning factor $n=\Phi/\alpha$, where $\phi=50°$ is the maximum angle of rotation of the billet until the direction of its rotation is changed, whence it follows that $n=50/40=1.25$; the difference between the angles of rotation towards one and the other side $\Delta\phi=20°$. The average total number of revolutions of the billet can be determined from the formula $$\nu=(S\cdot\Delta\phi/n\cdot 360°)=(90\cdot 20/1.25\cdot 360°)=4 \text{ rpm.}$$

Such a speed of rotation of both the coiled billet and the unreeling device employed in rolling tubes does not lead to the development of a cumulative torque applied to said billet. The section of the billet 1 located between the unreeling device and the rollers 5 of the turning gear is alternately being twisted through an angle $\phi=50°$ in one direction and through an angle $\angle\phi-\Delta\phi=50-20=30°$ in the opposite direction, the frequency of the twisting period of the billet 1 being equal to:

$$f=S/n=90/1.25=72 \text{ period/min.}$$

As is evident from the above example, the working conditions of the gears, making up the turning circuit, are substantially improved.

The turning of the billet 1, after its end portion 12 has emerged from the rollers 5, is effected in the following manner. The interior of the oval billet 1 which has been sized by the rollers 5 reproduces the cross-section of the shank 7 of the mandrel 6, the shank 7 being therefore free to travel axially within the billet 1, but not being able to turn relative to said billet 1. Hence, the mandrel 6 is turned positively through the billet 1, shank 7 and rod 8 by the turning gear rollers 5. In the zone of deformation of the end portion 12 of said billet 1 the mandrel 6 is disposed inside the billet 1 without any clearances, and turns the billet 1 by the friction forces. Such frictional forces arising between the billet 1 and the mandrel 6 can be increased by using in the draft zone of the billet 1 a mandrel 6 that is faceted in cross-section, which does not affect the quality of the finished tube 9, insofar as the mandrel 6 employed in the tube sizing zone has a conventional round shape. The finished tube 9 is wound around the reel 10 in the coil 11.

We claim:

1. A method of pilger rolling of tubes, comprising the steps of feeding a billet in portions into pilger rolls and working said billet on a mandrel during each rolling period with said billet being positively turned about the rolling axis both in one direction and in the opposite direction over the entire rolling period during its deformation and in the off-contact time, when said billet comes out of engagement with said rolls; whereby the rolling of tubes of hard-to-form metals and alloys is practicable and whereby their properties are enhanced.

2. A method, as claimed in claim 1, wherein the billet is turned in each direction through the same angle.

3. A method, as claimed in claim 1, wherein the turning of said billet in one direction is effected for some part of the rolling period.

4. A method, as claimed in claim 1, wherein the billet is turned in one direction through an angle differing from the angle of rotation in the opposite direction by about 15°–40°.

5. A method, as claimed in claim 4, wherein in the course of said billet rolling from a coil, the coil is turned simultaneously with said billet in the direction of a greater turning angle of said billet.

* * * * *